US011167916B2

(12) United States Patent
Proctor

(10) Patent No.: US 11,167,916 B2
(45) Date of Patent: Nov. 9, 2021

(54) MODULAR CONTAINER SYSTEM

(71) Applicant: MODULAR TANKING SOLUTIONS (MAURITIUS) LTD, Ebene (MU)

(72) Inventor: Clint Steel Proctor, Durban (CA)

(73) Assignee: MODULAR TANKING SOLUTIONS (MAURITIUS) LTD, Ebene (MU)

( * ) Notice: Subject to any disclaimer, the term of this patent is extended or adjusted under 35 U.S.C. 154(b) by 0 days.

(21) Appl. No.: 16/980,552

(22) PCT Filed: Mar. 13, 2019

(86) PCT No.: PCT/IB2019/052032
§ 371 (c)(1),
(2) Date: Sep. 14, 2020

(87) PCT Pub. No.: WO2019/175794
PCT Pub. Date: Sep. 19, 2019

(65) Prior Publication Data

US 2021/0002069 A1 Jan. 7, 2021

(30) Foreign Application Priority Data

Mar. 15, 2018 (NL) ..... 2020593

(51) Int. Cl.
*B65D 88/12* (2006.01)
*B65D 90/20* (2006.01)
(Continued)

(52) U.S. Cl.
CPC ..... *B65D 88/128* (2013.01); *B65D 90/20* (2013.01); *B65D 88/72* (2013.01); *B65D 90/10* (2013.01); *B65D 90/14* (2013.01); *B65D 90/30* (2013.01)

(58) Field of Classification Search
CPC ..... B65D 88/128; B65D 88/129; B65D 88/1656; B65D 90/14; B65D 88/48;
(Continued)

(56) References Cited

U.S. PATENT DOCUMENTS 5,069,352 A * 12/1991 Harbolt et al.
9,885,484 B2 * 2/2018 Young
(Continued)

FOREIGN PATENT DOCUMENTS

DE 202006002564 U1 4/2006
DE 202009001825 U1 7/2009
(Continued)

OTHER PUBLICATIONS

International Searching Authority, International Search Report and Written Opinion for International Application No. PCT/IB2019/052032, dated Jul. 30, 2019, (16 pages), U.S. Patent and Trademark Office, U.S.

*Primary Examiner* — Anthony D Stashick
*Assistant Examiner* — Raven Collins
(74) *Attorney, Agent, or Firm* — Alston & Bird LLP

(57) ABSTRACT

This invention relates to a transportable modular container system for fluid freight. The transportable modular container system comprises a container module including a reservoir configured to hold a fluid; an adjustable support for the container module, removably securable to a load area of a freight carrying transport and reciprocatingly adjustable between proximate and distal positions, the container module being located relatively closer to the load area in the proximate position than in the distal position, and wherein a zone for secondary freight is defined between the container module and the load area when the adjustable support is in the distal position and removably secured to the load area of the freight carrying transport; and a removable fluid flow
(Continued)

control module for controlling fluid flow of the fluid between an external reservoir and the container module reservoir and releasably connectable to the container module.

19 Claims, 11 Drawing Sheets

(51) Int. Cl.
*B65D 88/72* (2006.01)
*B65D 90/10* (2006.01)
*B65D 90/14* (2006.01)
*B65D 90/30* (2006.01)

(58) Field of Classification Search
CPC ..... B65D 88/54; B65D 88/74; B65D 88/747; B65D 88/1675; B65D 90/023
USPC ..... 410/2
See application file for complete search history.

(56) References Cited

U.S. PATENT DOCUMENTS

| | | | | |
|---|---|---|---|---|
| 2012/0138630 | A1* | 6/2012 | Bennetto | |
| 2012/0155982 | A1* | 6/2012 | Bennetto et al. | |
| 2014/0263690 | A1* | 9/2014 | Eckman | |
| 2017/0036182 | A1* | 2/2017 | Westlind | B01F 3/12 |
| 2017/0174425 | A1* | 6/2017 | Huang | B65D 88/52 |

FOREIGN PATENT DOCUMENTS

| | | | |
|---|---|---|---|
| WO | WO-2001/058717 | A1 | 8/2001 |
| WO | WO-2001/062545 | A1 | 8/2001 |
| WO | WO-2011/027305 | A1 | 3/2011 |

* cited by examiner

MODULAR CONTAINER SYSTEM

CROSS REFERENCE TO RELATED APPLICATIONS

This application is a National Stage Application, filed under 35 U.S.C. § 371, of International Application No. PCT/IB2019/052032, filed Mar. 13, 2019, which international application claims priority to and the benefit of Netherlands Application No. 2020593, filed Mar. 15, 2018; the contents of both of which as are hereby incorporated by reference in their entirety.

BACKGROUND

Related Field

This invention relates to a transportable modular container system for fluid freight.

It is known that deadheading or dead-legging, i.e. the completion of a trip with no cargo, is a major cost driver in the transportation of freight as well as having a major impact on carbon emissions and road surface damage over time. This cost and impact is exacerbated in long-distance transportation, especially in areas where road infrastructure is underdeveloped and transport time and risks are heightened.

Accordingly, and in an attempt to negate the costs and impact of deadheading, there exists solutions for allowing transportation of a certain consignment from a dispatching site, such as a port, to a destination site, and upon offloading of the load at the destination site, loading a second consignment to be transported back to the dispatching site, or to a second destination site. The main challenge posed by the above problem is the transportation of fluids requiring a tank, the tank commonly configured for a specific fluid, such as, but not exclusively, granular solids, dry powder, petrochemical products, hazardous, non-hazardous or other dangerous or heated fluid freight.

Known in the art are tank containers which comprise a rigid tank housed in a framework. This allows the transport and storage of fluid freight similar to freight carried in conventional containers. The major disadvantage is that the known tank containers are completely separate in their function from any transport vehicle, which ultimately limits their applicability where specific requirements, such as dual-purpose transportation, is an important consideration. Furthermore, a transportation vehicle load area carrying the known tank container is limited to carrying only the tank container, even in the event that the tank container is not carrying any fluid freight.

Accordingly, the disadvantage remains that, upon a fluid consignment reaching a destination site by tank mounted on a truck or a trailer, the tank structure remains in place, even upon emptying the tank, and bars the carrying of any cargo on the trailer for which the tank is not specifically designed to carry.

In an attempt to overcome this challenge there exists dual-purpose trailer arrangements for allowing adjustment of the tank relative to the trailer, to allow storage and transport of goods on the trailer on top of the tank or beneath the tank.

WO 01/58717 A1 discloses a trailer body defined by sides and a rigid tank supported on a base that is movable between an upper and a lower position within the body. If the base is moved to an upper position relative to the body, the body allows for storage of goods. The main disadvantage of this solution is that the trailer, body and rigid tank form an integral system whereby the body cannot transport goods without the rigid tank residing on top, and the rigid tank cannot transport goods without being attached to the body. This means that, should the tank transport a fluid to a destination site, the fluid must be vacated from the rigid tank before the body and trailer can return to a dispatching site or second destination site carrying a further consignment. Furthermore, the solution assumes that the destination site has the facilities to receive the full fluid consignment, accordingly, the solution is impractical for many rural or remote applications.

DE 20 2006 002564 U1 discloses a further solution to the problem posed above, with a focus on a baffled rigid tank integrally formed within a shielded loading area of a trailer. The baffled rigid tank is moveable between a lowered position and an upper position, the tank remaining within the shielded loading area. The solution offered by DE 20 2006 002564 U1 does not overcome the disadvantages of WO 01/58717 A1, but rather offers the same solution with increased costs and complexity of implementation.

DE 20 2009 001825 U1 discloses a transport vehicle comprising a chassis with a cargo space on the chassis. The cargo space is a shielded loading area containing an adjustable and flexible bag. This solution has the distinct disadvantage that it would not be feasible in the transportation of certain dangerous and/or corrosive goods. Further to the above, it again does not overcome the disadvantages of WO 01/58717 A1 nor DE 20 2006 002564 U1, and again provides a costly and complex alternative to the above solutions.

WO 11/27305 A1 discloses a tank arrangement for a freight transportation vehicle providing for the carriage of fluid freight and general dry freight. The main distinction is that it hints towards the potential of the tank arrangement being removable from the transportation vehicle chassis. The distinct disadvantage in WO 11/27305 A1 is that it provides an intricate and expensive solution which requires significant functionality of the transportation vehicle chassis in order for the tank arrangement to be accommodated. Due to the significant functionality of the transport vehicle chassis to accommodate the tank arrangement, the transport vehicle would necessarily be dedicated to carry the specific tank arrangement. This increases costs and decreases ease and scope of application. Furthermore, once the tank arrangement disclosed in WO 11/27305 A1 is removed from the transport vehicle chassis, it loses the functionality provided by the transport vehicle chassis.

DESCRIPTION OF RELATED ART

Accordingly, it is an object of the present invention to provide a transportable modular container system with which the applicant believes the aforementioned disadvantages and problems may at least partially be alleviated or which may provide a useful alternative for the known dual-purpose arrangements.

BRIEF SUMMARY

According to the present invention there is provided a transportable modular container system comprising:

- a container module including a reservoir configured to hold a fluid;
- an adjustable support for the container module, removably securable to a load area of a freight carrying transport and reciprocatingly adjustable between proximate and distal positions, the container module being located relatively closer to the load area in the proximate position than in the distal position, and wherein a zone for secondary freight is defined between the container module and the load area when the adjustable support is in the distal position and removably secured to the load area of the freight carrying transport; and a removable fluid flow control module for controlling fluid flow of the fluid between an external reservoir and the container module reservoir and releasably connectable to the container module.

The removable fluid flow control module may be provided with a mounting formation for releasably mounting the control module to the freight carrying transport. The mounting formation may be a slidable bracket arrangement mounted to the freight carrying transport.

The adjustable support may be a plurality of struts removably fixed to the container module. Furthermore, the struts may be removably fixed to the container module by means of a pivot for adjusting the support between the proximate and the distal position, the struts may further be releasably securable in the proximate and distal positions through a locking means.

The adjustable support may be removably securable to the load area of a freight carrying transport in the proximate and in the distal position by means of a securing means. The securing means may be a twist lock and corner block arrangement known in the art.

The container module may further include a lifting formation for lifting of the container module and thereby also facilitating reciprocal adjustment of the adjustable support between the proximate and the distal position. The lifting formation may further be in the form of forklift slots, or in the form of an engaging formation for operatively engaging a lifting crane. The lifting formation may also be in the form of a pressurised fluid lifting ram. The pressurised fluid lifting ram may further be in fluid flow connection with a pressurised fluid system of the freight carrying transport.

The container module reservoir may include a valve arrangement for allowing charging or discharging of the fluid, the valve arrangement may comprise a passage, the lowest point of which corresponding to a base of the container module reservoir and extending sideways from the container module reservoir to a valve, rendering the base of the container module reservoir as the lowest extremity of the container module reservoir and thereby maximising the zone for secondary freight.

The container module and the removable fluid flow control module may be configured to carry and charge dangerous fluid goods, the removable fluid flow control module may then comprise of a control selected from the group consisting of a loading valve detachably connectable between an external dangerous goods reservoir and the valve arrangement, a vapour recovery valve, a pneumatic control valve, an emergency cut-off switch, an earth lead and a combination thereof.

The container module may further be configured to carry and discharge a dry powder, including granular solids, the container module reservoir may then include a tapered section at an end, tapering to the valve arrangement, and fluidising air jets proximate the valve arrangement for fluidising the dry powder during discharge. The removable fluid flow control module may then further be configured to discharge the dry powder, the removable fluid flow control module then comprising of a vacuum pump system detachably connectable to an external dry powder reservoir. The fluidising air jets may receive pressurised air from the vacuum pump system.

The container module reservoir may include a recessed manhole, the recessed manhole may comprise of elements selected from the group of a cover, an access, pipework, air ventilation openings, a positive internal valve, a vapour recovery element detachably in fluid flow connection with the vapour recovery valve of the control module, an overfill sensor, a coaming vent, a roll-over protection element and a combination of same.

The container module may even further be configured to carry and charge heated fluid freight, the container module reservoir may then include a first reservoir for receiving the heated fluid freight, and a second reservoir for receiving a heating fluid. The removable fluid flow control module may also then be configured to charge the second reservoir with a natural gas, the removable fluid flow control module then including a control valve detachably connectable to an external natural gas reservoir. The second reservoir may further include a burner for combustion of the natural gas. The container module may even further include a thermal insulation element surrounding the container module reservoir in order to comply with International Standards for external temperature regulations.

The container module may be stackable with further container modules when the adjustable support is removed from the load area of the freight carrying transport. The removable fluid flow control module may allow charging or discharging of the container module reservoir when the adjustable support is removed from the load area of the freight carrying transport and the container module is stacked with further container modules.

BRIEF DESCRIPTION OF THE FIGURES

The invention will now further be described, by way of example only, with reference to the accompanying drawings wherein.

DETAILED DESCRIPTION OF VARIOUS EMBODIMENTS

The invention described herein is not to be limited in scope by the specific embodiments herein disclosed, as the embodiments are intended as illustrative of several aspects of the invention. Any equivalent embodiments are intended to be within the scope of this invention, as they will become apparent to those skilled in the art from the present description.

Figure 1:
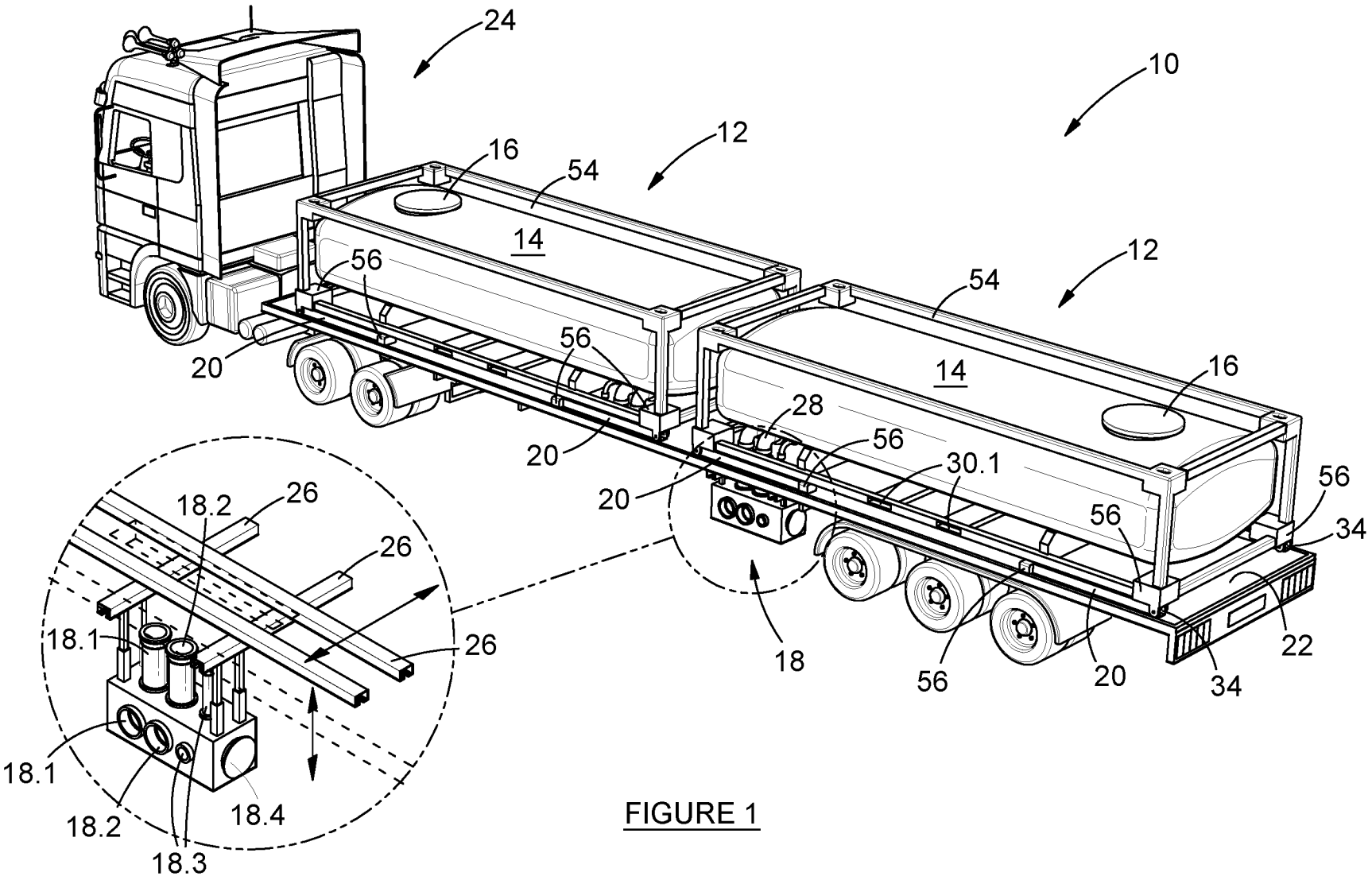
FIG. 1 is a perspective view of the transportable modular container system according to a first embodiment of the present invention, with the adjustable support in the proximate position.

FIG. 1 shows a first example embodiment of a transportable modular container system 10 according to the present invention. The transportable modular container system 10 is shown to comprise two container modules 12, each including a reservoir 14 which is configured to transport dangerous fluid freight (not shown) and set in a frame 54. Dangerous fluid freight in this context is considered to be fluid freight within the definition of the European Agreement Concerning the International Carriage of Dangerous Goods by Road (ADR). The reservoir accordingly configured to comply with the ADR requirements and further national regulations such as the South African National Standard (SANS) 1518 regulations and the American Petroleum Institute (API) standards.

The container module reservoir 14 is further shown to include a recessed manhole 16 including an access 16.1, air ventilation openings 16.2, a vapour recovery element 16.3 detachably in fluid flow connection with a vapour recovery valve 18.2 of a removable fluid flow control module 18. The recessed manhole 16 further includes a coaming vent 16.3, an overfill sensor 16.4 and a roll-over protection element 16.6. Manhole pipework 16.7 is fitted inside the container module reservoir 14.

FIG. 1 further shows the transportable modular container system 10 to comprise an adjustable support 20, as a plurality of struts removably fixed to the container module by means of a pivot 34, for supporting the container module 12. The struts 20 are removably secured to a load area 22 of a freight carrying transport 24 in a proximate position by means of corner blocks 56 and twist locks (not shown) as securing means. The struts 20 are releasably secured in the proximate position by a locking means 20.1 (shown in FIG. 3), the container module 12, being in the proximate position, located relatively closer to the load area 22 of the freight carrying transport 24, as compared to when the struts are in a distal position (shown in FIGS. 3 and 4).

The transportable modular container system 10 in FIG. 1 is further shown to comprise the removable fluid flow control module 18 as stated above, releasably mounted to the freight carrying transport 24 by means of a slidable bracket arrangement 26 as a mounting formation. The removable fluid flow control module 18 is shown to comprise a loading valve 18.1, detachably connectable between an external dangerous fluid reservoir (not shown) and a valve arrangement 28 of the container module reservoir 14, the vapour recovery valve 18.2 detachably in fluid flow connection with the vapour recovery element 16.3, a pneumatic control valve 18.3, an earth lead 18.4 and an emergency cut off switch 18.5 (shown in FIG. 5). The valve arrangement 28 is shown to comprise a passage 28.1 (clearly shown in FIG. 5), the lowest point of which corresponds with the base of the container module reservoir 14 and extending sideways from the container module reservoir 14 to a valve 28.2 (clearly shown in FIG. 5).

Finally, FIG. 1 shows the transportable modular container system 10 to include a lifting formation 30, in the form of forklift slots 30.1, for the container module 12. The forklift slots 30.1 allows a forklift 32 (shown in FIGS. 9 and 10) to lift the container module 12 thereby either removing the container module 12 from the load area 22 of the freight carrying transport 24 or facilitating reciprocal adjustment of the struts 20 between the proximate position (shown in FIG. 1) and the distal position (shown in FIGS. 3 and 4).

Figure 2:
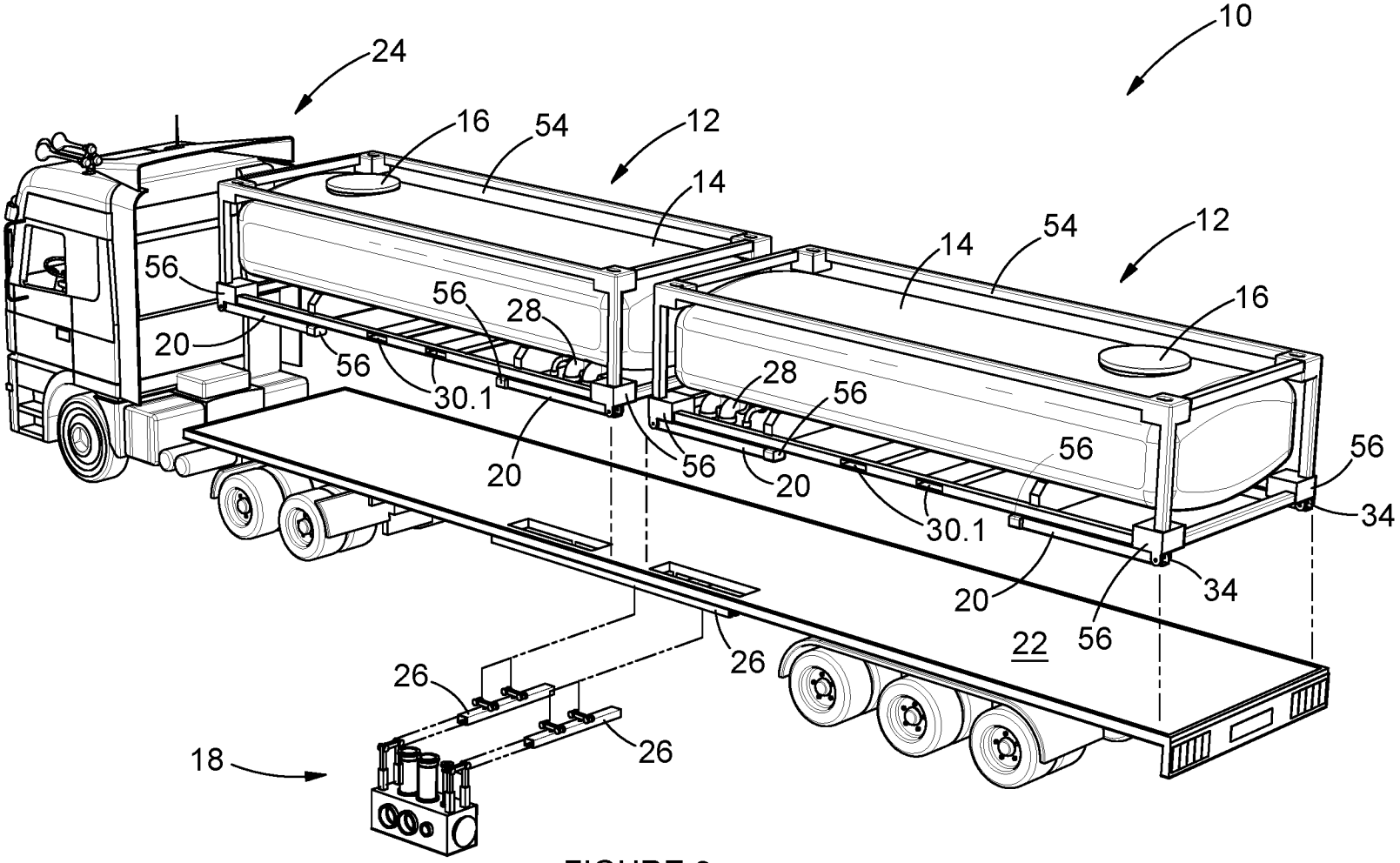
FIG. 2 is an exploded perspective view of the transportable modular container system of FIG. 1.

As stated, FIG. 2 is an exploded perspective view of the transportable modular container system 10 of FIG. 1. It shows that, once the container module 12, the adjustable support and the control module 18 are removed from freight carrying transport, the freight carrying transport is able to be used for any further intended applications.

Figure 3:
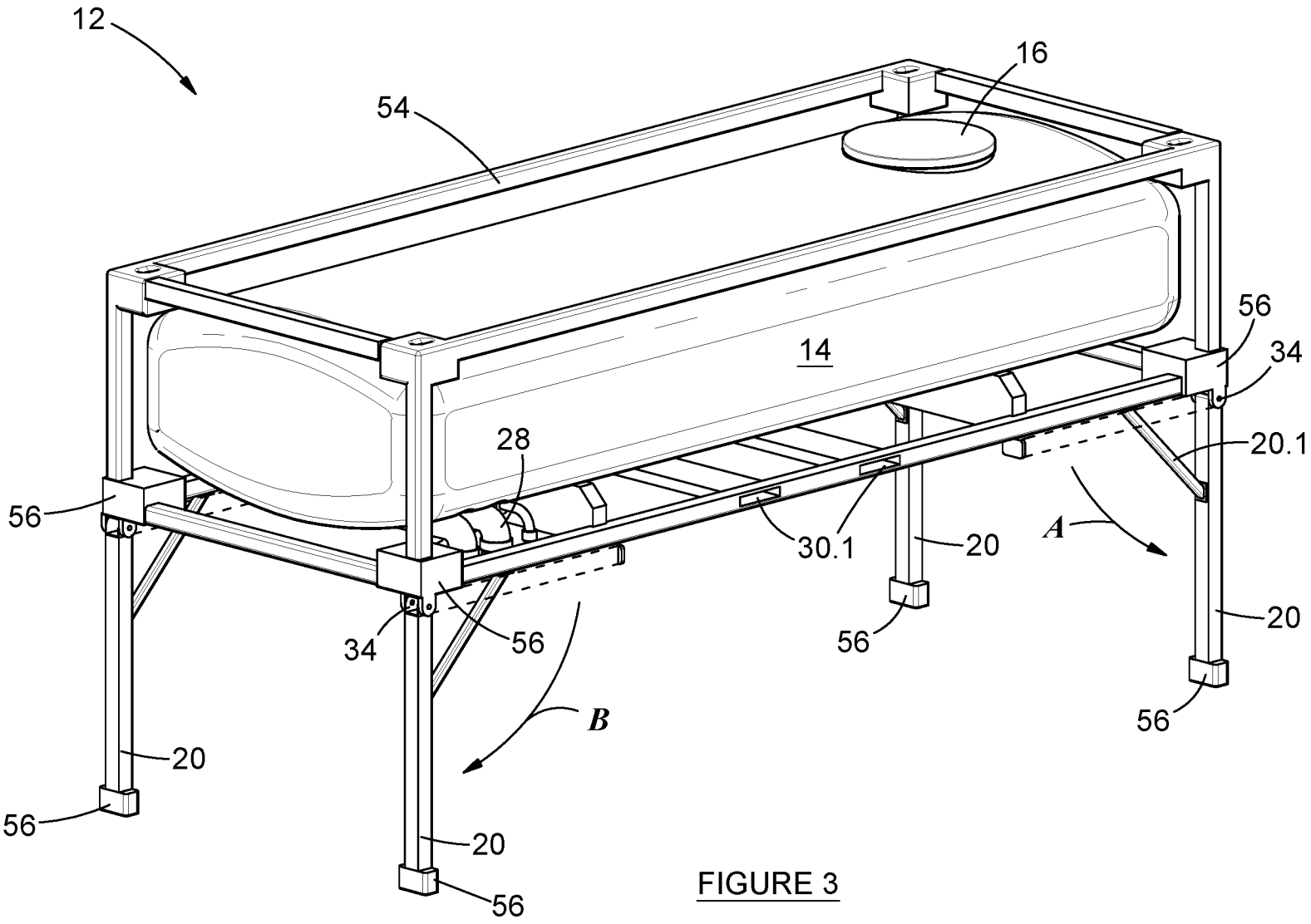
FIG. 3 is a perspective view of the container module and the adjustable support of FIG. 1, the adjustable support moved from the proximate to the distal position.

FIG. 3 shows the container module 12 and adjustable support struts 20 moved from the proximate position to the distal position (direction of movement indicated by arrows A and B) by means of the pivot 34 removably fixing the adjustable support struts 20 to the container module 12. The adjustable support struts 20 are then releasably secured in the distal position through the locking means 20.1.

Figure 4:
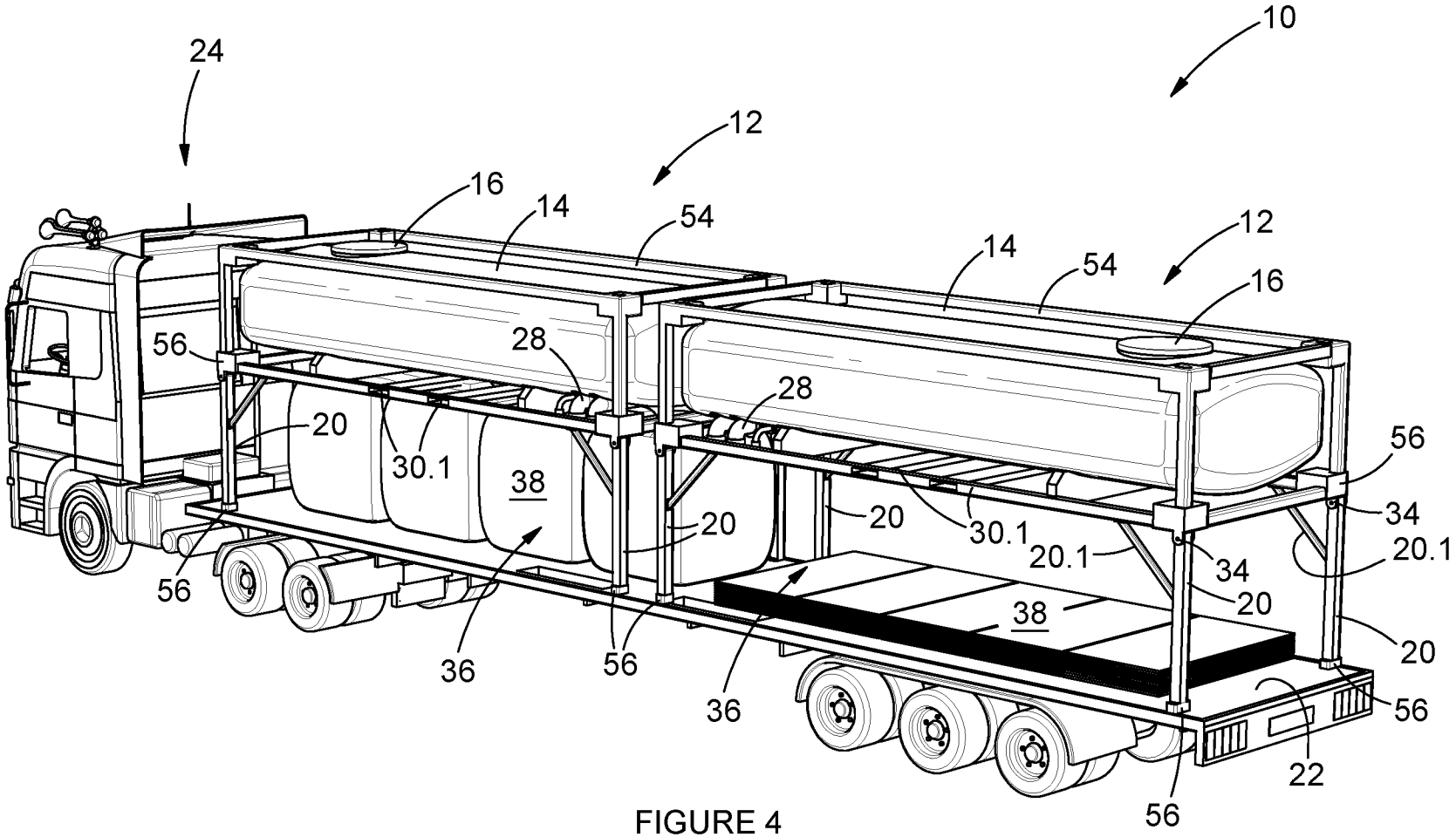
FIG. 4 is a perspective view of the transportable modular container system of FIG. 1, the adjustable support in the distal position and secured to the loading area of the freight carrying transport by means of corner blocks and twist locks, accordingly defining a zone for secondary freight.

FIG. 4 shows the transportable modular container system 10 of FIG. 1, the adjustable support struts 20 moved from the proximate position to the distal position (as per FIG. 3), releasably secured in the distal position by means of the locking means 20.1, and removably secured to the load area 22 of the freight carrying transport 24 by means of corner blocks 56 and twist locks (not shown) as the securing means. Accordingly, a zone 36 for secondary freight 38 is defined between the container module 12 and the load area 22. This allows storage and transport of secondary freight 38, such as bulk dry freight, on the load area 22 when the container module reservoir 14 is empty. This allows the freight carrying transport 24 to maintain a sufficiently low centre of mass relative to a transport surface (not shown) and simultaneously avoid the disadvantages of deadheading.

Figure 5:
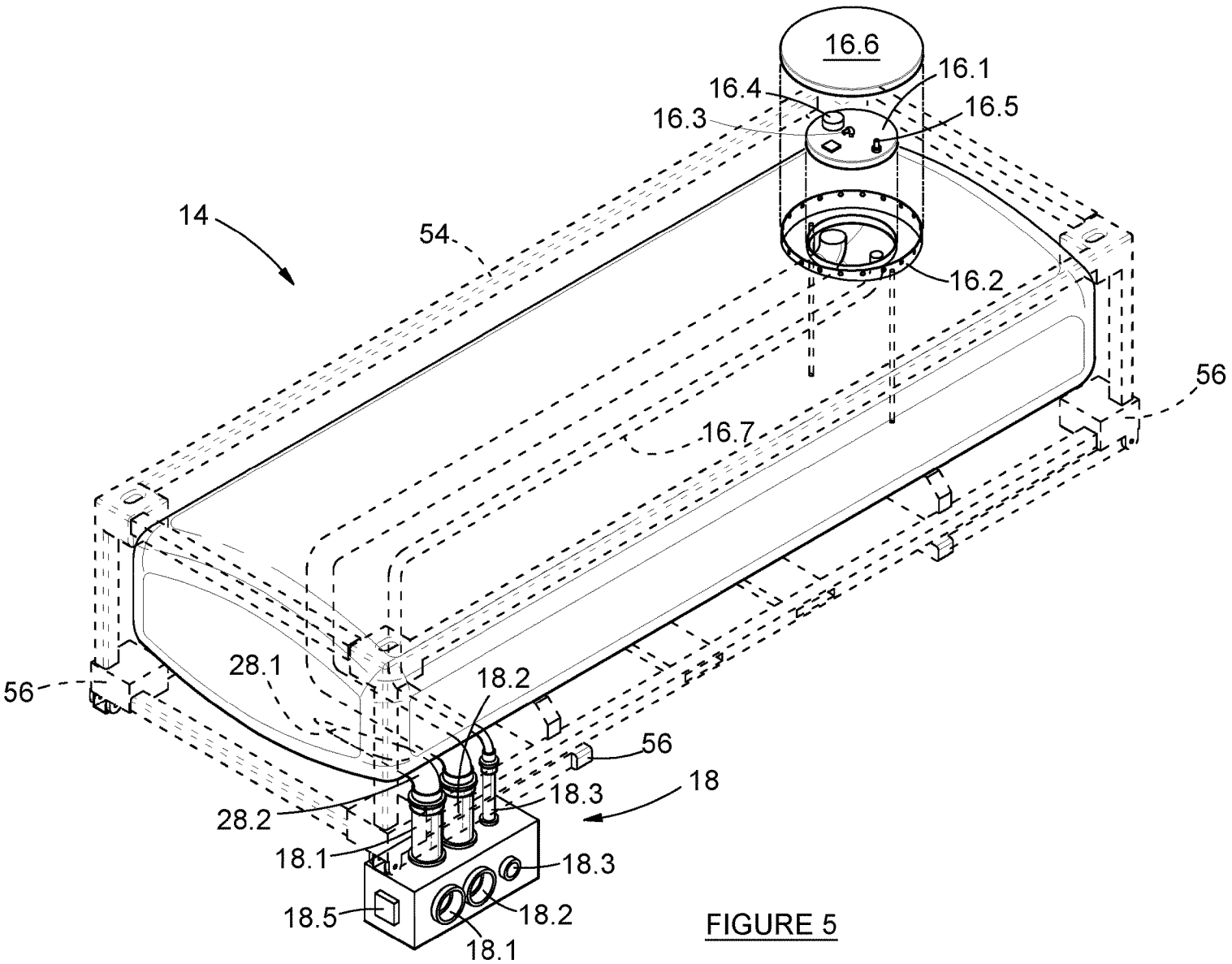
FIG. 5 is a partially transparent perspective view of the container module and the removable fluid flow control module of FIG. 1, together with an exploded view of a recessed manhole configured for dangerous fluid transport.

FIG. 5 shows the container module reservoir 14 of FIG. 1, the container module reservoir 14 including a recessed manhole 16 comprising an access 16.1, air ventilation openings 16.2, a vapour recovery element 16.3 detachably in fluid flow connection with the vapour recovery valve 18.2 of the removable fluid flow control module 18. The recessed manhole 16 is further shown to comprise a coaming vent 16.3, an overfill sensor 16.4 and a roll-over protection element 16.6. As stated, the manhole pipework 16.7 is shown to be fitted inside the container module reservoir 14. Accordingly, in use the recessed manhole 16 allows for air ventilation without permitting water or rain to enter while furthermore rendering the container module 12 operational for transporting dangerous fluid freight as defined by the ADR.

From FIGS. 1 through 5, it is evident that in use the transportable modular container system 10 allows a user with access to any freight carrying transport 24 which has a loading area 22, such as a flatbed, to temporarily and with great ease, convert the freight carrying transport to an ADR, and where relevant SANS 1518 and API standards, compliant and certified dangerous fluid freight carrying transport. The releasable mounting formation 26 with a slidable bracket arrangement for mounting the control module 18 to the transport 24 then allows the certified dangerous fluid carrying transport 24 to be able to effectively, and in any prescribed manner, connect to an external dangerous fluid reservoir (not shown), such as a reservoir at a petrochemical refinery as a dispatching site, to charge the container module reservoir 14 with the dangerous fluid freight (not shown).

The user can then remove the control module 18 from the mounting formation 26, to be stored on the transport 24 or kept at the dispatching site for safe keeping should the destination site for the dangerous fluid freight be a high risk rural area. The transport 24 can then travel with the fluid freight to the destination site with the container module support struts 20 removably secured to the load area 22 in the proximate position, thereby maintaining the centre of mass of the transport 24 at a safe height relative to the traveling surface. Once the transport 24 arrives at the destination site, the user has the option to discharge the fluid freight to an external reservoir (not shown) through the valve arrangement 28. After discharging the fluid freight, the user can then make use of a forklift 32 (readily available at even the most rural sites) to lift the container module 12 by means of the forklift slots 30.1, and then adjusting and securing container module support struts 20 in the distal position, and further releasably securing the container module support struts 20 to the load area 22 of the transport 24, thereby defining a zone 36 for secondary freight 38, such as bulk dry freight.

The user can then proceed to load bulk dry freight 38, such as mining or agricultural commodities or reagents, in the zone 36. Thereafter the user can return to the dispatching site, or a second destination site, with the bulk dry freight 38 and the empty container module 12, ready for further use. Should the transport then be required for any other applications, the container module 12 can be removed from the load area 22 and stored for future use. Accordingly, the user can make use of the transportable modular container system 10 without rendering his transport unusable for any further intended applications.

The transportable modular container system 10 as shown in FIGS. 1 through 5 gives the user the further option of removing the charged container module 12 from the load area 22 of the transport 24 upon reaching a destination site that does not have the infrastructure to allow offloading of the fluid freight. After removing the charged container module 12 from the load area 22 of the transport 24, the transport 24 can be used for any further intended applications, while the container module 12 can act as a safe storage unit at the destination site, configured and certified to safely carry the dangerous fluid it is intended for.

Figure 6:
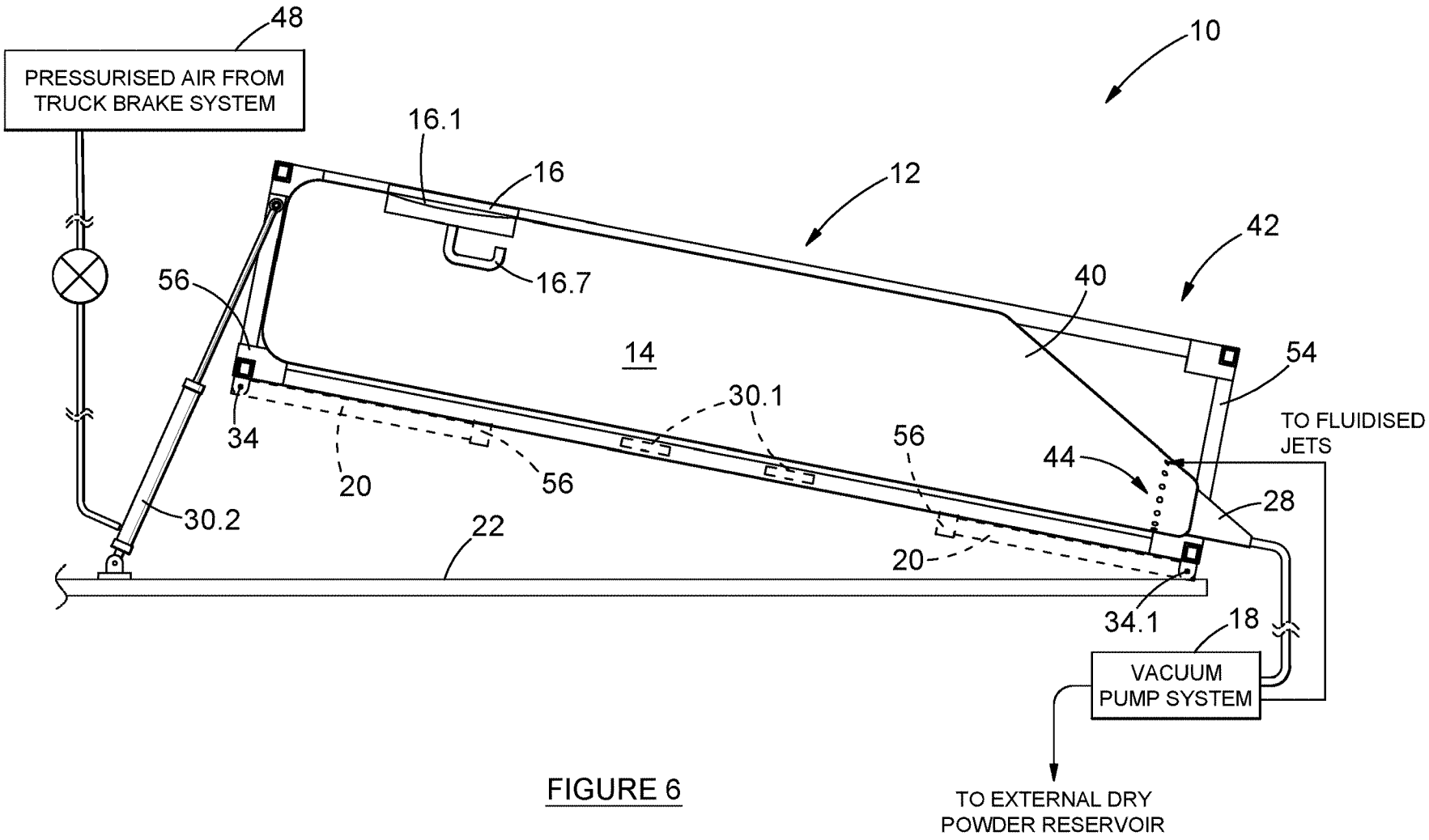
FIG. 6 is a side view of the transportable modular container system according to a second embodiment of the present invention, wherein the container module is configured to carry and discharge dry powder, further including a pressurised fluid lifting ram and a schematic diagram of the interaction with a vacuum pump system as the removable fluid flow control module.
Figure 7:
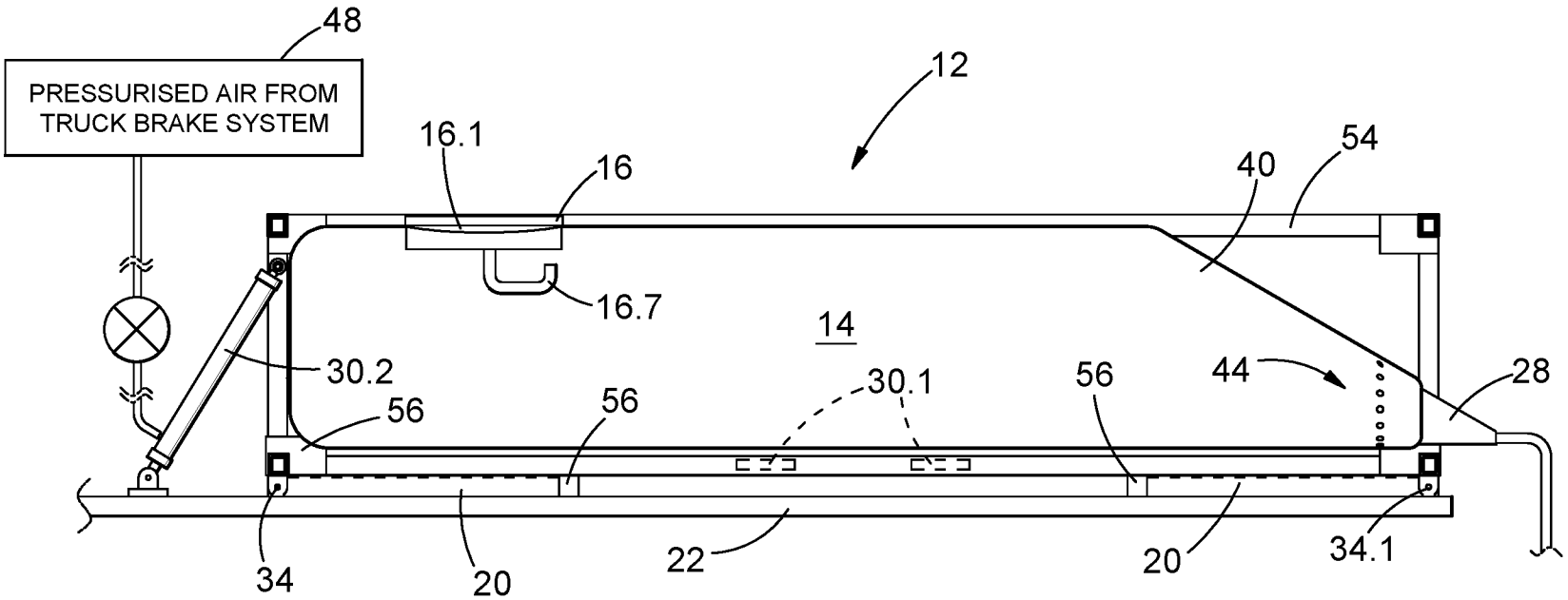
FIG. 7 is a further side view of the transportable modular container system of FIG. 6, as configured during transport when the container module reservoir is charged.

FIG. 6 shows a second example embodiment of the transportable modular container system 10 according to the present invention, during discharge of the container module reservoir 14. The transportable modular container system 10 is shown to comprise of a container module 12 including a reservoir 14 configured to carry and discharge a dry powder (not shown), including granular solids, as the fluid freight, set in a frame 54. This configuration entails the container module reservoir 14 having a tapered section 40 at an end 42, tapering to the valve arrangement 28. Furthermore, it entails the container module reservoir 14 having fluidising air jets 44 proximate the valve arrangement 28 for fluidising the dry powder during discharge through the valve arrangement 28. It also entails the container module 12 to include a pressurised fluid lifting ram 30.2, pneumatic, hydraulic or otherwise, for lifting the container module 12 at one end, allowing effective discharge of the dry powder freight. The pressurised fluid lifting ram 30.2 is shown in a deployed state, but is movable between the deployed state and a contracted state (as shown in FIG. 7) as is known in the art. The pressurised fluid lifting ram 30.2 is further shown to be in fluid flow connection with a pressurised fluid system 48, herein the pressurised air from a brake system, of the freight carrying transport 24 (shown in FIGS. 1, 2 and 4). Finally, the configuration entails the container module 12 having a recessed manhole 16 comprising an access 16.1 and a positive internal valve 16.7 to facilitate discharge of the dry powder freight.

The transportable modular container system 10 of FIG. 6 is further shown to comprise adjustable support struts 20 removably securable to the load area 22 of the freight carrying transport 24 by means of a corner block 56 and twist lock arrangement as securing means. The adjustable support struts 20 being reciprocatingly adjustable between proximate and distal positions by means of the pivots 34 removably fixing the adjustable support struts 20 to the container module 12. The figure shows the adjustable support struts 20 releasably secured in the proximate position by means of a locking means 20.1. The transportable modular container system 10 is also shown to comprise a vacuum pump system 18 as the removable fluid flow control module. The vacuum pump system 18 allows for suction of the dry powder freight from the container module reservoir 14, while providing pressurised air to the fluidising air jets 44.

FIG. 7 shows the transportable modular container system 10 of FIG. 6, during transport of the container module 12. The pressurised fluid lifting ram 30.2 is shown in the contracted state with all the adjustable support struts 20 removably secured to the load area 22 of the freight carrying transport 24 in the proximate position by means of a corner block 56 and twist lock arrangement as securing means.

Figure 8:
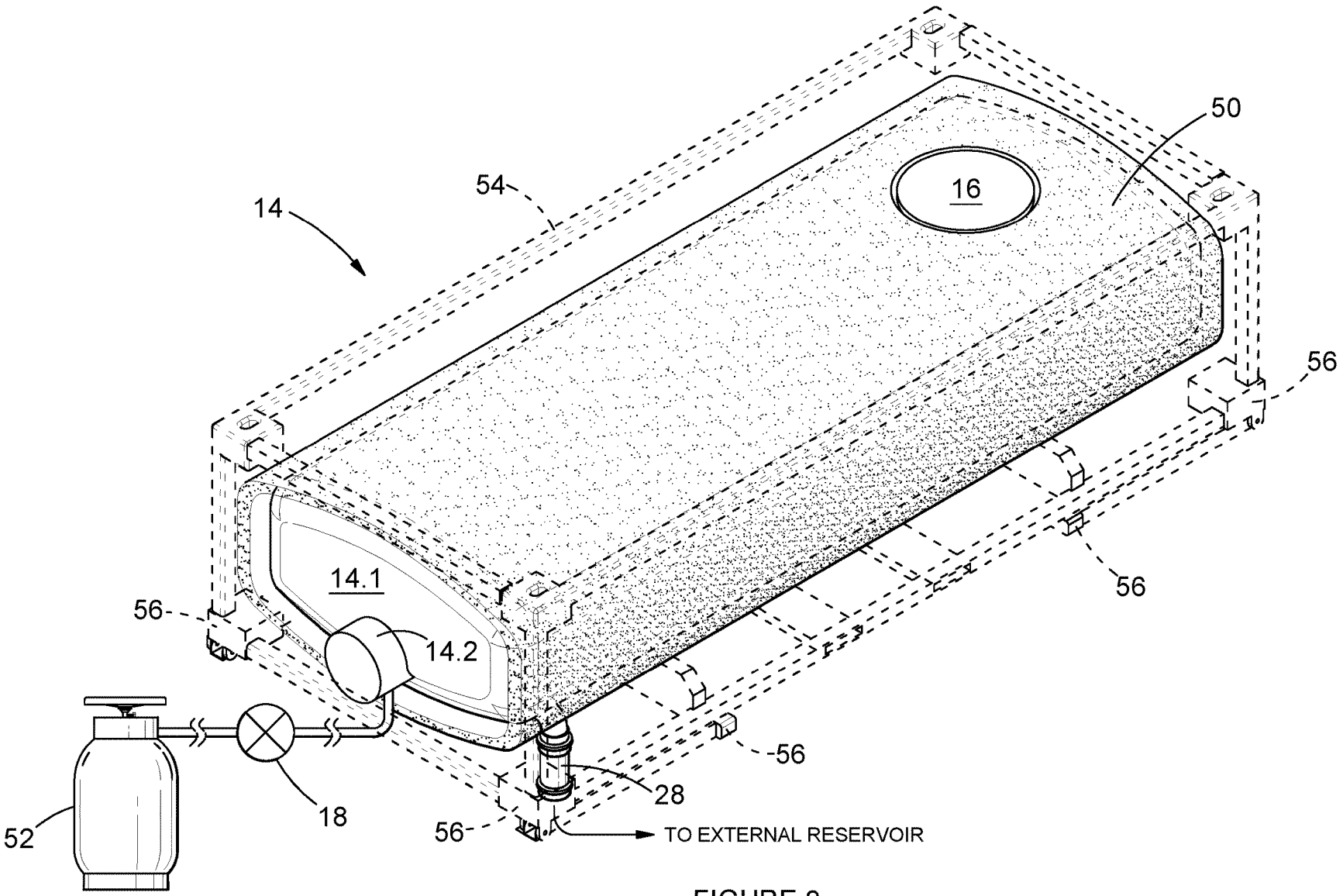
FIG. 8 is a perspective view of the transportable modular container system according to a third embodiment of the present invention, wherein the container module is configured to carry and charge heated fluid freight.

FIG. 8 shows a third example embodiment of the container module 12 and the removable fluid flow control module 18 of the transportable modular container system 10 according to the present invention. The container module reservoir 14 is shown to be configured to carry, charge and discharge a heated fluid (not shown) as the fluid freight. This configuration entails the container module reservoir 14 comprising of a first reservoir 14.1 for charging and discharging, via the valve arrangement 28, and carrying the heated fluid freight, as well as a second fluid reservoir 14.2 for receiving a heating fluid, such as a natural gas (not shown). The second fluid reservoir 14.2 includes a burner (not shown) for combustion of the natural gas. The configuration further entails the container module reservoir 14 including a thermal insulation element 50, such as a glass wool blanket known in the art, surrounding the container module reservoir 14. This thermal insulation element sufficient to comply with International Standards for external temperature regulations.

The transportable modular container system 10 is also shown schematically to comprise a removable fluid flow control module 18 as a control valve detachably connectable to an external natural gas reservoir 52. The external natural gas reservoir 52 can be a natural gas tank of the freight carrying transport 24 (shown in FIGS. 1, 2 and 4). Furthermore, the adjustable support 20 for the container module 12 and the lifting formation 30 are not shown in this figure in order to show more clearly the container module reservoir 14 configuration, but can be, but is not limited to, any of the lifting formations 30 as shown in FIGS. 1 through 7.

These configurations of the container module reservoir 14, the configuration to hold dry powder freight and enable discharge of same, coupled with the vacuum pump system 18 as the removable fluid flow control module as per FIGS. 6 and 7, and the configuration to hold heated fluid freight and enable charging and discharging of same, coupled with the control valve 18 as the removable fluid flow control module as per FIG. 8, provides a transportable modular container system 10 which is easily, time and cost effectively interchangeable with the first example embodiment of the transportable modular container system 10 as per FIGS. 1 through 5. Thereby, a user having access to only a freight carrying transport 24 with a load area 22 is able to, without any substantial adjustments and without any intricate and costly support measures, interchange between an ADR configured and certified transport, a dry powder or granular solids transport, a heated liquid transport and a bulk dry freight 38 transport by loading, offloading and adjustment of the container module 12 as described above. This simultaneously eliminates deadheading while also not restricting delivery to destination sites having the infrastructure to receive same as the container module 12 can be offloaded at the destination site along with the removable fluid flow control module 18 and act as a modular warehouse on location.

Figure 9:
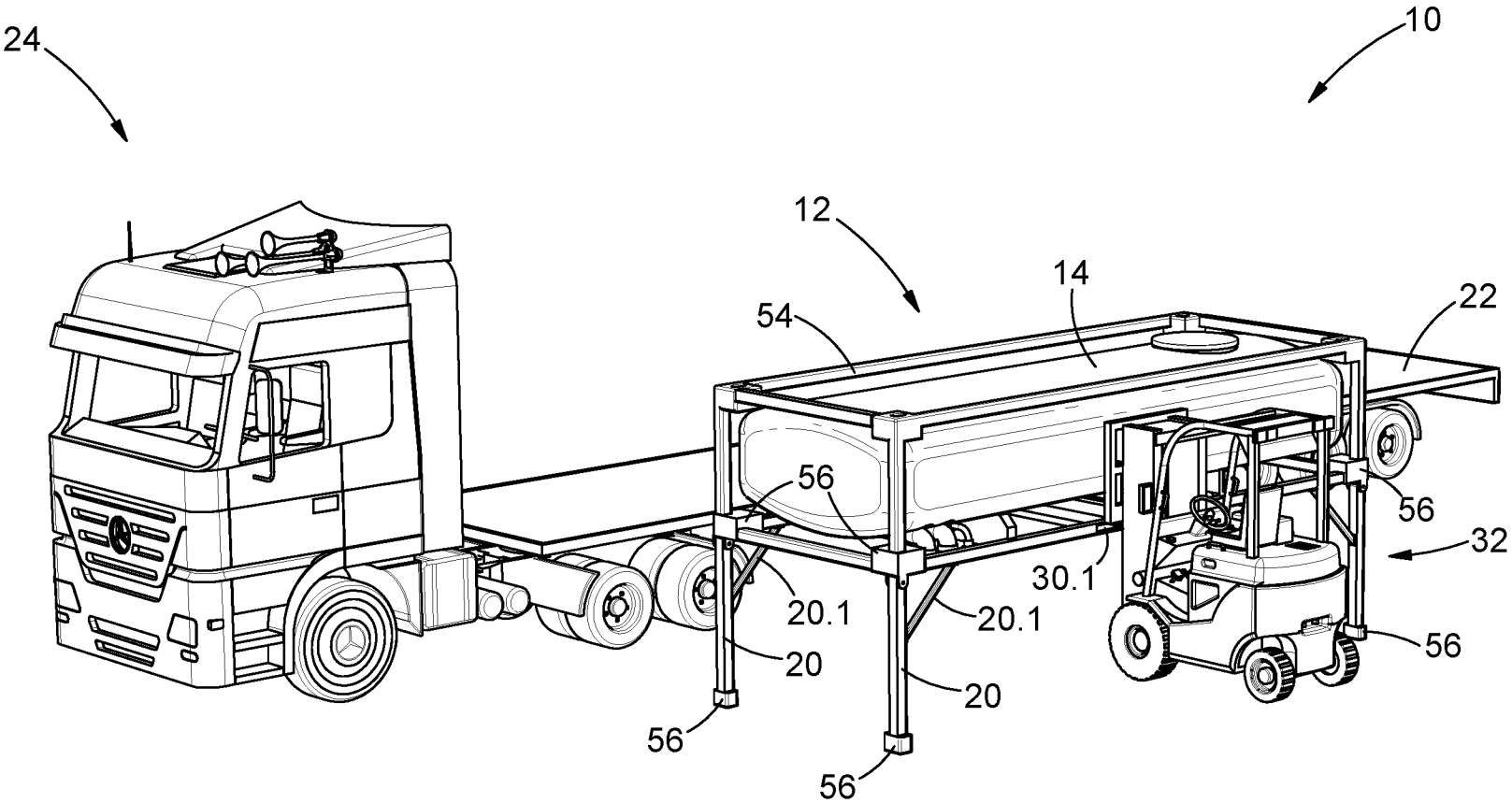
FIG. 9 is a perspective view of the transportable modular container system of FIG. 1, wherein the container module and adjustable support, in the distal position, are removed from a freight carrying transport load area by a forklift engaging forklift slots of the container module.
Figure 10:
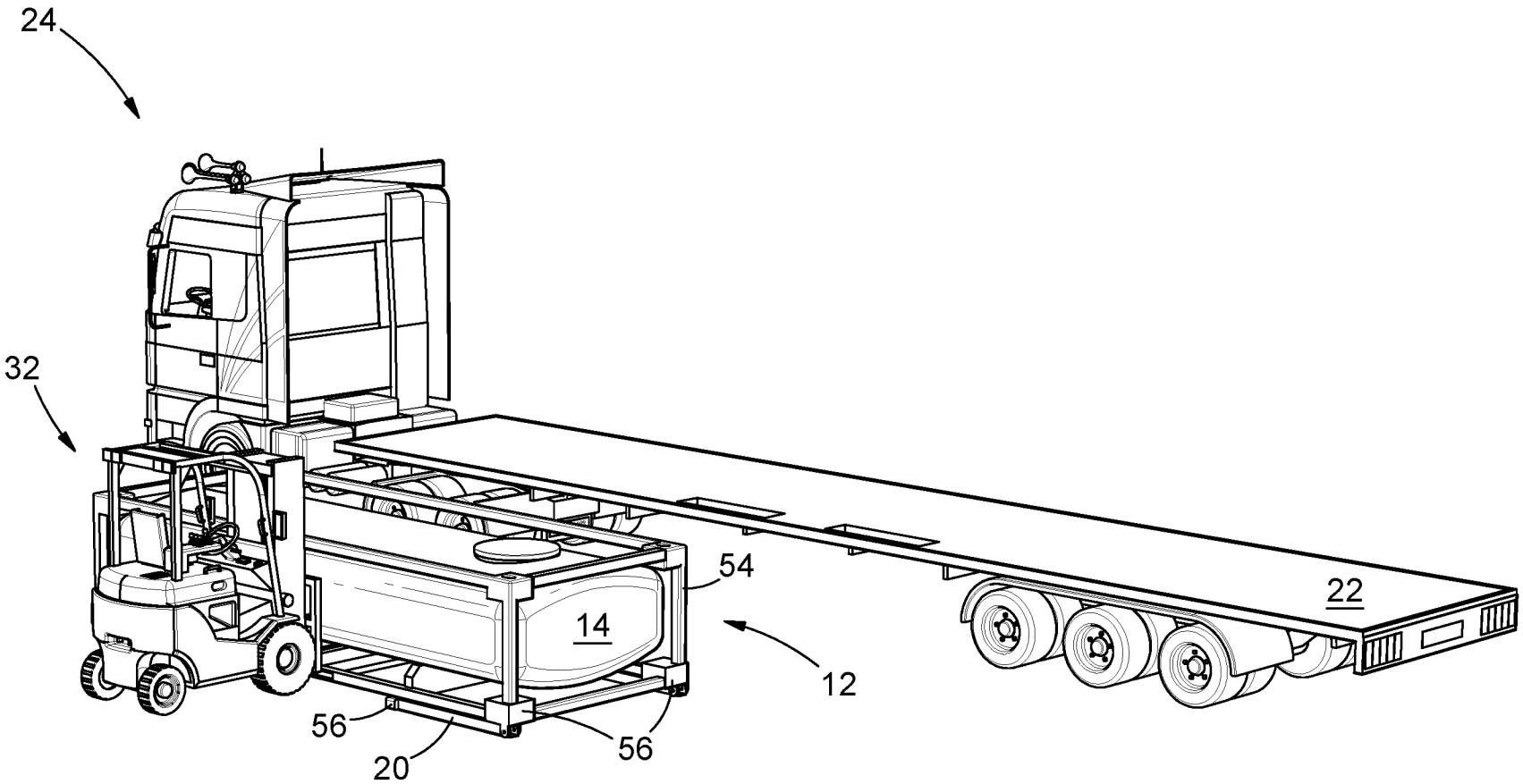
FIG. 10 is a perspective view of the transportable modular container system of FIG. 1, wherein the container module and adjustable support, in the proximate position, are removed from a freight carrying transport by a forklift engaging forklift slots of the container module.

FIGS. 9 and 10 show the transportable modular container system 10 of FIGS. 1 through 5 of the present invention, wherein the container module 12 is being loaded and offloaded, by means of a forklift 32 engaging the forklift slots 30.1 as lifting formation, to and from the load area 22 of the freight carrying transport 24. It is to be appreciated that the container module 12 may be configured as per FIGS. 1 through 8. Furthermore, it is to be appreciated that the freight carrying transport 24 may be any transport means used for the transportation of fluid freight by road, rail or sea, where the transport includes a load area 22, such as a flatbed, but not limited to same. More particularly, the freight carrying transport 24 is envisaged to be a vehicle selected from the group of semi-trailer trucks, jumbo-trailer trucks, straight trucks, truck trailers and flatbed trucks.

Figure 11:
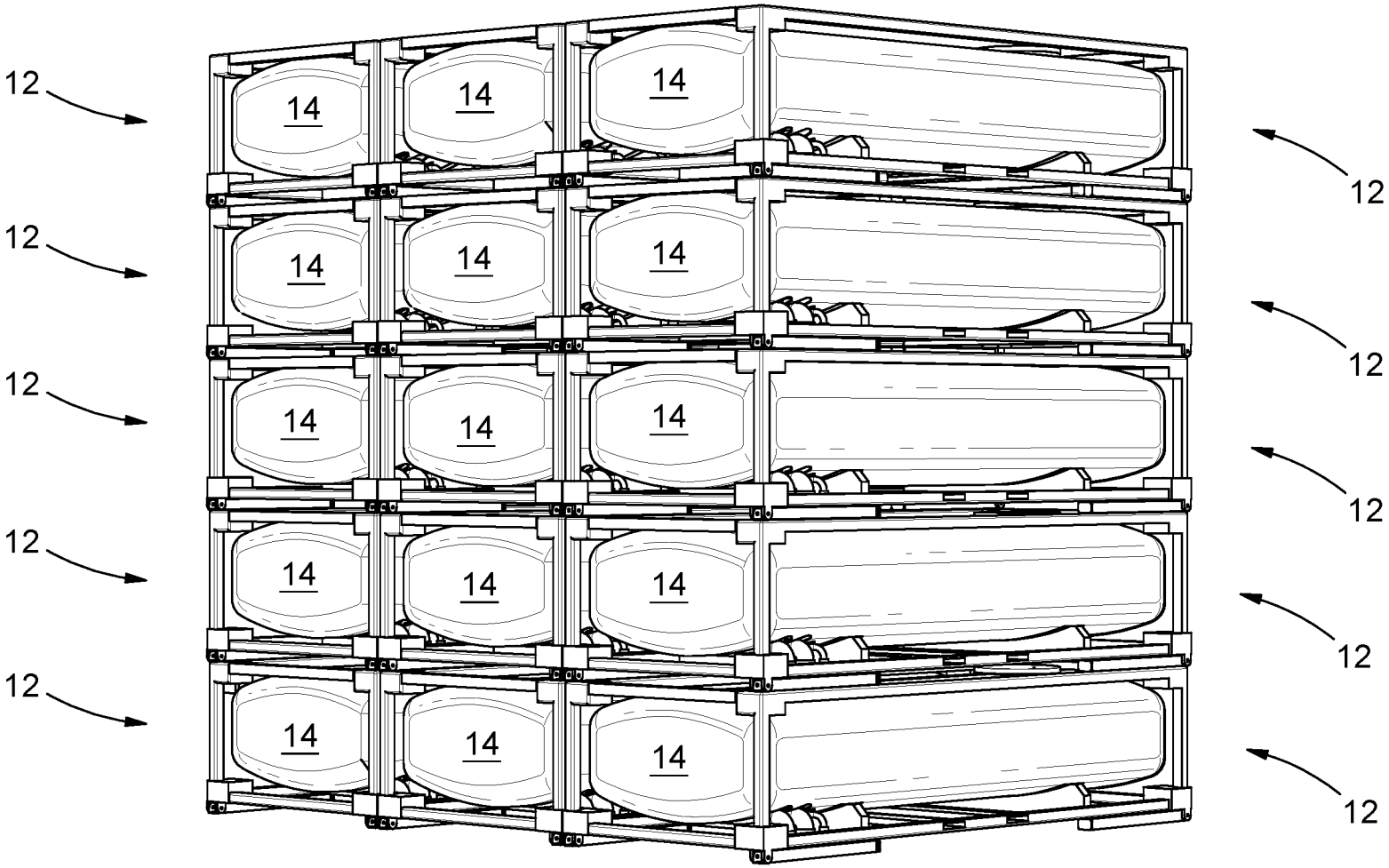
FIG. 11 is a perspective view of the container module of FIG. 1, wherein the container module is stacked with further container modules after the adjustable support has been removed from the load area of the freight carrying transport.

FIG. 11 shows the container module 12 of FIGS. 1 through 5 of the present invention, stacked with further container modules 12 when the adjustable support 20 is removed from the load area 22 of the freight carrying transport 24. It is to be appreciated that the container module 12 may be configured as per FIGS. 1 through 8 and remain stackable with container modules 12 sharing the same configuration or container modules 12 having different configurations. The removable fluid flow control module 18 can be used to charge or discharge the container module reservoir 14 when the adjustable support 20 is removed from the load area 22 of the freight carrying transport 24 and the container modules 12 are stacked with further container modules 12.

It was surprisingly found that by using a combination of adjustable supports 20 with container modules 12 having dedicated and configured reservoirs 14, in combination with a dedicated removable fluid flow control module 18, the disadvantages of the prior art were substantially overcome and the carbon emissions and road surface damage can be substantially reduced. Accordingly, with the transportable modular container system 10 of the present invention, a user only having access to a freight carrying transport 24 having a loading area 22, can easily as well as time and cost effectively be enabled to convert the freight carrying transport 24 into an interchangeable transport being an ADR configured and certified transport, a dry powder or granular solid transport, a heated liquid transport and a bulk dry freight 38 transport by loading, offloading and adjustment of the container module 12, container module support 12 and the removable fluid flow control module 18. Simultaneously, the problem of deadheading is resolved together with the issue of transport and storage to rural areas where road and freight storage infrastructure is underdeveloped and transport time and risks are heightened. Finally, the transportable modular container system 10 provides a solution for reducing the significant carbon emissions by freight transport activities and the damage caused to road surfaces by same.

The invention claimed is:

1. A transportable modular container system comprising:

a container module including a reservoir configured to hold a fluid and a valve arrangement for at least one of charging or discharging of the fluid from the reservoir;

an adjustable support for the container module, removably securable to a load area of a freight carrying transport and reciprocatingly adjustable between proximate and distal positions, the container module being located relatively closer to the load area in the proximate position than in the distal position, and wherein a zone for secondary freight is defined between the container module and the load area when the adjustable support is in the distal position and removably secured to the load area of the freight carrying transport; and a removable fluid flow control module for controlling fluid flow of the fluid between an external reservoir and the container module reservoir, the removable fluid flow control module being releasably mounted directly to the freight carrying transport and releasably connected to the valve arrangement of the container module reservoir, the releasable mount and connection enabling selective removal of the fluid flow control module prior to transport of the container module on the freight carrying transport.

2. The transportable modular container system of claim 1 wherein the adjustable support is a plurality of struts removably fixed to the container module.

3. The transportable modular container system of claim 2, wherein the struts are removably fixed to the container module by means of a pivot for adjusting the support between the proximate and the distal position, the struts releasably securable in the proximate and distal positions through a locking means.

4. The transportable modular container system of claim 1, wherein the adjustable support is removably securable to the load area of a freight carrying transport in the proximate and in the distal position by means of a securing means.

5. The transportable modular container system of claim 4, wherein the container module includes a lifting formation for lifting of the container module and thereby facilitate reciprocal adjustment of the adjustable support between the proximate and the distal position.

6. The transportable modular container system of claim 1, wherein the valve arrangement comprises a passage, the lowest point of which corresponding to a base of the container module reservoir and extending sideways from the container module reservoir to the valve arrangement, rendering the base of the container module reservoir as the lowest extremity of the container module reservoir and thereby maximising the zone for secondary freight.

7. The transportable modular container system of claim 6, wherein the container module and the removable fluid flow control module are configured to carry and charge dangerous fluid goods, the removable fluid flow control module comprising of a control selected from the group consisting of a loading valve detachably connectable between an external dangerous fluid reservoir and the valve arrangement, a vapour recovery valve, a pneumatic control valve, an emergency cut-off switch, an earth lead and a combination thereof.

8. The transportable modular container system of claim 6, wherein the container module is configured to carry and discharge a dry powder, the container module reservoir including a tapered section at an end, tapering to the valve arrangement, and fluidising air jets proximate the valve arrangement for fluidising the dry powder during discharge; and the removable fluid flow control module configured to discharge the dry powder, the removable fluid flow control module comprising of a vacuum pump system detachably connectable to an external dry powder reservoir.

9. The transportable modular container system of claim 7, wherein the container module reservoir includes a recessed manhole, the recessed manhole comprising elements selected from the group of a cover, an access, pipework, air ventilation openings, a positive internal valve, a vapour recovery element detachably in fluid flow connection with the vapour recovery valve of the control module, an overfill sensor, a coaming vent, a roll-over protection element and a combination of same.

10. The transportable modular container system of claim 1, wherein the container module is configured to carry and charge heated fluid freight, the container module reservoir including a first reservoir for receiving the heated fluid freight and a second reservoir for receiving a heating fluid.

11. The transportable modular container system of claim 10, wherein the second reservoir includes a burner for combustion of a natural gas as the heating fluid.

12. The transportable modular container system of claim 10, wherein the container module includes a thermal insulation element surrounding the container module reservoir.

13. The transportable modular container system of claim 1, wherein the container module is stackable with further container modules when the adjustable support is removed from the load area of the freight carrying transport.

14. The transportable modular container system of claim 13, wherein the removable fluid flow control module allows charging or discharging of the container module reservoir when the adjustable support is removed from the load area of the freight carrying transport and the container module is stacked with further container modules.

15. The transportable modular container system of claim 1, wherein the removable fluid flow control module is releasably mounted directly to the freight carrying transport via a mounting formation.

16. The transportable modular container system of claim 15, wherein the mounting formation is a slidable bracket arrangement.

17. The transportable modular container system of claim 16, wherein the slidable bracket arrangement comprises at least a first set of bracket members oriented to enable adjustability in a direction perpendicular to an outwardly oriented face of the removable fluid flow control module.

18. The transportable modular container system of claim 17, wherein the slidable bracket arrangement further comprises a second set of bracket members are oriented perpendicular to the first set of bracket members, such that the slidable bracket arrangement enables two-directional adjustability of the mounting between the removable fluid flow control module and the freight carrying transport.

19. The transportable modular container system of claim 16, wherein the removable fluid flow control module is releasably mounted to the valve arrangement of the container module reservoir through an opening in the load area of the freight carrying transport.

* * * * *